US011492740B2

(12) United States Patent
Bringewatt et al.

(10) Patent No.: US 11,492,740 B2
(45) Date of Patent: Nov. 8, 2022

(54) METHOD AND APPARATUS FOR TREATING LAUNDRY

(71) Applicant: Herbert Kannegiesser GmbH, Vlotho (DE)

(72) Inventors: Wilhelm Bringewatt, Porta Westfalica (DE); Engelbert Heinz, Vlotho (DE)

(73) Assignee: Herbert Kannegiesser GmbH, Vlotho (DE)

( * ) Notice: Subject to any disclaimer, the term of this patent is extended or adjusted under 35 U.S.C. 154(b) by 239 days.

(21) Appl. No.: 16/348,413

(22) PCT Filed: Nov. 2, 2017

(86) PCT No.: PCT/EP2017/001271
§ 371 (c)(1),
(2) Date: May 8, 2019

(87) PCT Pub. No.: WO2018/086729
PCT Pub. Date: May 17, 2018

(65) Prior Publication Data

US 2020/0056315 A1 Feb. 20, 2020

(30) Foreign Application Priority Data

Nov. 11, 2016 (DE) ..... 102016013380.5
Feb. 17, 2017 (DE) ..... 102017001586.4

(51) Int. Cl.
*D06F 31/00* (2006.01)
*D06F 58/12* (2006.01)
(Continued)

(52) U.S. Cl.
CPC ..... *D06F 31/00* (2013.01); *D06F 58/12* (2013.01); *D06F 60/00* (2013.01); *D06F 33/30* (2020.02);
(Continued)

(58) Field of Classification Search
CPC ..... D06F 31/00; D06F 58/12; D06F 95/00; D06F 2204/04; D06F 2204/06; D06F 2103/14
See application file for complete search history.

(56) References Cited

U.S. PATENT DOCUMENTS 1,487,914 A 3/1924 Leigh
1,998,912 A 4/1935 Max
(Continued)

FOREIGN PATENT DOCUMENTS

AU 7143674 A 1/1976
EP 2369051 A1 9/2011

OTHER PUBLICATIONS

Machine translation of EP 2369051 A1 to Bringewatt et al. (Year: 2011).*

(Continued)

*Primary Examiner* — Joseph L. Perrin
(74) *Attorney, Agent, or Firm* — Laurence P. Colton; Smith Tempel Blaha LLC

(57) ABSTRACT

Methods and apparatuses that provide for laundry to be washed and rinsed in a washing device in a state in which it lies spread out on an upper strand of a belt conveyor and, directly thereafter, to be dried in a likewise spread-out state on an upper strand of a belt conveyor. During the washing, rinsing and also the drying operations, the laundry rests on the belt conveyors, which also transport the laundry through the washing device and the dryer. The items of laundry here are washed, and also rinsed, by being sprayed with jets of liquid. The procedure described provides for a compact washing and drying system and is gentler on the items of laundry.

34 Claims, 6 Drawing Sheets

(51) Int. Cl.

| | |
|---|---|
| ***D06F 60/00*** | (2009.01) |
| *D06F 95/00* | (2006.01) |
| *F26B 3/04* | (2006.01) |
| *F26B 15/18* | (2006.01) |
| *D06F 33/30* | (2020.01) |

(52) U.S. Cl.
CPC ..... *D06F 95/00* (2013.01); *F26B 3/04* (2013.01); *F26B 15/18* (2013.01)

(56) References Cited

U.S. PATENT DOCUMENTS

| | | | | | |
|---|---|---|---|---|---|
| 2,265,071 | A * | 12/1941 | Hartenbach, Jr. | D06F 58/12 | 34/464 |
| 2,366,136 | A | 12/1944 | Waldstein | | |
| 2,506,476 | A * | 5/1950 | Troy | D06F 58/12 | 34/586 |
| 3,574,526 | A | 4/1971 | Bell | | |
| 3,961,503 | A * | 6/1976 | Grantham | D06F 95/00 | 68/27 |
| 4,453,386 | A * | 6/1984 | Wilkins | D06G 1/00 | 68/19.1 |
| 6,189,170 | B1 | 2/2001 | Sherwood | | |
| 2004/0025311 | A1* | 2/2004 | Kjellberg | D06F 31/00 | 26/1 |
| 2006/0130243 | A1* | 6/2006 | Ozaltin | D06F 19/00 | 8/158 |
| 2010/0051058 | A1* | 3/2010 | Cotter | D06G 1/00 | 134/18 |
| 2012/0084927 | A1* | 4/2012 | Levy | D06F 31/00 | 8/137 |
| 2017/0059244 | A1* | 3/2017 | Biel | D06F 58/12 | |

OTHER PUBLICATIONS

WIPO, International Search Report (on priority application), dated Mar. 19, 2018.

* cited by examiner

METHOD AND APPARATUS FOR TREATING LAUNDRY

CROSS REFERENCE TO RELATED APPLICATIONS

This application is the US National Phase of and claims the benefit of and priority on International Application No. PCT/EP2017/001271 having a filing date of 2 Nov. 2017, which claims priority on and the benefit of German Patent Application No. 10 2016 013 380.5 having a filing date of 11 Nov. 2016 and German Patent Application No. 10 2017 001 586.4 having a filing date of 17 Feb. 2017.

BACKGROUND OF THE INVENTION

Technical Field

The invention relates to a method for the treatment, in particular the wet treatment, of laundry, wherein the laundry is washed in at least one liquid and subsequently rinsed; a method for the treatment, in particular the drying, of laundry, with the laundry being transported in a spread-out state on a conveyor through at least one drying section; and a method for the treatment, in particular the wet treatment and drying, of laundry which is washed and rinsed in the course of wet treatment and that during the drying phase the bound liquid from the wet treatment is extracted to at least a large extent. The invention also relates to a device for the treatment, in particular the wet treatment, of laundry having at least one wash zone and at least one rinse zone, wherein the laundry can be treated with liquid in the at least one wash zone and in the at least one rinse zone; a device for the treatment, in particular the drying, of laundry having at least one conveyor with an upper strand by means of which the spread-out laundry can be transported in the treatment direction for drying; and a device for the treatment, preferably wet treatment, of laundry having a washing device with a dryer.

Prior Art

Laundry, specifically items of laundry such as flat textiles, shaped items, or even cloth mangles, are usually washed and then dried.

The washing process is usually conducted in a washing machine with a rotating drum. In commercial laundries such machines are configured as elongated, drivable drums to form what are known as continuous-process washing machines. In the drum the laundry items are continuously circulated with a treatment liquid and thus washed in the process.

Particularly in commercial laundries, the drying of laundry items is also conducted in a dryer having a rotating drum. Here the laundry items are circulated in the drum as a result of the drum's rotating drive and the flow of air generated by the preferably hot drying air. Known washers and dryers have proven effective in practice, particularly in commercial laundries, although they exhibit certain disadvantages, for example that the continuous movement of the laundry items in the drums results in a mechanical stress on the laundry items and that the movement of the laundry items in the drums requires a significant amount of energy.

In order to eliminate the aforementioned disadvantages of prior art washers and dryers, various attempts at alternative washing and drying methods have already been made. However, up to now these have not been proven in practice.

Ultimately, in the case of all known washers and dryers an intermediate transport step from the washer to the dryer is required. This results in a large space requirement in the laundry.

BRIEF SUMMARY OF THE INVENTION

The invention is based on the object of providing methods and devices for the treatment of laundry, in particular laundry items, which are efficient and which provide for the most gentle treatment of the laundry possible.

A method for attaining this object is a method for the treatment, in particular the wet treatment, of laundry, wherein the laundry is washed in at least one liquid and subsequently rinsed, characterized in that the laundry is sprayed and/or sprinkled in the spread-out state with at least one liquid. According, it is provided that the laundry, in particular the laundry items, are sprayed and/or sprinkled with a liquid in a spread-out state, and are thereby washed. This can be accomplished without a rotating drum. It is also not necessary to continuously circulate the laundry items in the liquid employed for washing. As a result, the method according to the invention makes it possible to achieve a gentle and energy-efficient washing of resting laundry items.

The laundry or laundry items are preferably sprayed and/or sprinkled with pressurized liquid, resulting in the laundry being penetrated by the liquid under pressure. This may take the form of pressurized liquid jets, liquid mists and/or liquid spray cones. The spraying or sprinkling of the laundry items is preferably carried out at such an intensity that the laundry is washed hydrodynamically.

In addition to being sprayed and/or sprinkled, the laundry or laundry items can also be partially or completely dipped in a liquid. This preferably involves a spraying or sprinkling liquid that is caught in a collecting trough. During at least part of their treatment, the laundry or laundry items are sprinkled or sprayed and then moved, preferably drawn, through the liquid, preferably the same liquid, at least in part.

The liquid jets are preferably generated by nozzles, in particular high-pressure nozzles or high-pressure spray nozzles. The energy or the impetus of the liquid acting at relatively high speeds or under pressure results in a relative movement, preferably as cavitations and/or microjets, between the liquid and laundry items that is more intensive than the relative movement between the liquid used for washing and the laundry that is generated by the rotating drum in conventional washers.

In an advantageous embodiment of the method it is provided that the laundry items, situated in a spread-out flat and/or stationary state, are sprayed and/or sprinkled with liquid jets of at least one liquid and, if necessary, moved through a bath of liquid, preferably of the same liquid. It is particularly advantageous to have the at least one liquid penetrate the laundry items as they lie or rest in spread-out or extended state on at least one conveyor. Here the laundry items are not required to make any movement relative to the conveyor, in particular an upper strand, on which they lie, such that they lie or rest unmoved on the upper strand of the conveyor. As the conveyor further transports the laundry items lying spread-out or flat on the upper strand, they are continuously moved past the liquid jets. The nozzles for generating the liquid jets can be disposed in a stationary position above the upper strand of the conveyor.

One advantageous possible embodiment of the method provides that the at least one liquid is sprayed and/or sprinkled on a free side, preferably a top side, of the laundry items and that at least a portion of this liquid is drained off from the laundry items at an opposite side, preferably a bottom side. Here it has proved expedient for a conveyor belt, which carries the laundry items to be washed, to be liquid-permeable in design. The liquid jets impacting the top side of the laundry items at a high velocity and under pressure can pass or flow unimpeded through not only the laundry items but also through the upper strand of the conveyor supports it and thereby generate a hydrodynamic cavitation which has a cleansing and/or rinsing effect on the laundry. This occurs preferably by means of high-pressure liquid jets having a high pulse power.

In a preferred refinement of the method, which however may also constitute an independent patentable method, a disinfection by means of ultrasound and peracetic acid is carried out during the washing process, preferably between successive washing steps, during the final washing step and/or prior to rinsing. It is advantageous to conduct this disinfection with peracetic acid in a liquid bath, with the laundry items being transported through the liquid bath for purposes of disinfection. The liquid bath is set to oscillate by means of ultrasound.

The concentration of the peracetic acid in the liquid bath with water, in particular sterilized water, can be very low if, pursuant to the invention, ultrasonic waves are generated in the liquid bath in addition. It is then sufficient for the water to have a very low peracetic acid concentration of 0.02% to 4%, in particular 0.04% to 2%. The efficacy of the peracetic acid is increased by the disinfection of the laundry items in the ultrasonic cleaning bath that is enriched with peracetic acid. The peracetic acid is capable of reaching all locations in the fabric of the laundry items. The disinfection process can therefore be conducted with a lower peracetic acid concentration in the disinfection bath if ultrasonic oscillations are generated in the latter by means of at least one sonotrode or the like. Above all, this allows the disinfection process to be completed more rapidly so that the duration of the washing procedure is not increased.

The improved effect of the peracetic acid in the disinfection liquid is primarily due to the fact that the ultrasonic disinfection process with peracetic acid exerts a hydrodynamic, acoustic gravitation force on the laundry items to be disinfected in the disinfection liquid. As a result, the disinfection in the ultrasonic cleaning bath can be conducted more rapidly and, above all, with a lower peracetic acid concentration in the water, in particular sterilized water.

In an advantageous refinement of the method, it is provided that at least a part of the liquid bound in the laundry or laundry items is removed after and/or during the washing procedure. As a result, dirt bound by the liquid is separated from the liquid or is taken away with the liquid when it is removed from the laundry. This results in a more effective wet treatment that is subsequently carried out. This is particularly the case if a portion, especially a relatively large portion, of the liquid bound in the laundry is removed from the latter by mechanical and/or pneumatic means prior to rinsing.

It can also be advantageous to separate at least a large portion of the liquid that is still bound (absorbed liquor), above all the bound rinsing liquid, from the laundry items after they have been rinsed. This results in a pre-dewatering and/or pre-drying of the laundry items, with the result that less energy is expended in the subsequent drying cycle.

In one possible refinement of the method, it is provided to wash the laundry in a prewash zone and in a main wash zone and to rinse it in at least one rinse zone, preferably a process water rinse zone and a fresh water rinse zone. The plurality of zones make it possible to achieve an intensive washing and/or rinsing process.

The laundry items are preferably transported in succession through the individual zones by the common conveyor in the direction of treatment. In the case of the method according to the invention, there is no need for any time-consuming reloading of the laundry items from one zone to another, as is the case in conventional continuous-process washing machines.

A device for achieving the object of the invention a device for the treatment, in particular the wet treatment, of laundry having at least one wash zone and at least one rinse zone, wherein the laundry can be treated with liquid in the at least one wash zone and in the at least one rinse zone, characterized by a conveyor having a strand, by means of which the laundry spread out on the strand in a lying state can be transported through the at least one wash zone and the at least one rinse zone and with means for the spraying and/or sprinkling of the laundry with liquid employed for washing and rinsing being arranged above the strand of the conveyor which carries the laundry. This device provides that the laundry, which lies on a conveyor in a spread-out state, is transported by the latter through the at least one wash zone and the at least one rinse zone, with nozzles for wetting and/or spraying the laundry or laundry item being assigned to the conveyor. As a result, the laundry items are not actually freely movable during the wet treatment. Instead, the laundry items rest on the conveyor and are transported by the latter through the individual zones, preferably all zones, of the device. In the process, the laundry items rest on the conveyor as they are moved past the nozzles. For that reason, the nozzles can assume a stationary position above the conveyor and the laundry items lying on it. If necessary, however, it can be provided that the nozzles can move relative to the conveyor and the laundry items lying and/or resting on it.

It is preferably provided for the nozzles, which are realized as high-pressure nozzles, for example, to be arranged, preferably in a stationary position, in at least one row transverse to the transport direction of the conveyor and above an upper strand of the latter. The laundry items can thus be impacted across their entire width from above by liquid from at least one row of nozzles.

The at least one row of nozzles arranged next to one another extends preferably across the entire working width of the conveyor. The nozzles are preferably spaced apart from one another such that they can treat the laundry completely with liquids across the entire width and/or working width of the conveyor. It is also conceivable that the spacing of the nozzles is selected such that their jets overlap. This ensures a thorough penetration of the liquid in the laundry across the entire width of the conveyor.

One advantageous further embodiment of the device provides that at least one water extraction device for the mechanical and/or pneumatic removal of at least one part of the liquid bound in the laundry is arranged at least on the end of the wash zone or of the final wash zone. As a result, at least one part of the liquor bound in the laundry is removed along with the liquid used for washing and possibly also with dirt in the laundry before it is rinsed. This results in a more effective rinsing of the laundry.

Pursuant to an advantageous embodiment of the device, the conveyor is realized as a belt conveyor having at least one conveyor belt driven in rotation. This at least one conveyor belt is preferably designed to be liquid-permeable. The at least one conveyor belt allows for a continuous further transport of the laundry resting and spread out on it, with the laundry being continuously sprayed and/or sprinkled with liquid from the nozzles bit by bit. Due to the liquid-permeable configuration of the at least one conveyor belt, the liquid can flow through the laundry items and can be drained off along with the entrained dirt through the at least one liquid-permeable conveyor belt and into at least one collecting trough, for example. The conveyor belt of the belt conveyor can also be guided at least in sections through the collecting trough with washing liquid. In this way, the laundry lying spread out on the belt conveyor is additionally conveyed, in particular drawn, through the liquid in the collecting trough that is used for spraying and/or sprinkling. This results in a more intensive washing procedure.

The liquid caught in the collecting trough, the so-called process liquid, can be recovered and/or reused. This is accomplished by transporting the liquid, in particular the process liquid, back in the direction opposite to the treatment direction of the laundry, for example to the start of the device, in particular to the wash zone of the latter. If necessary, the returned liquid can necessary be processed prior to its reuse, for example by means of filters and/or subsequent metering of wash-active agents or the like.

To ensure that the conveyor belt is sufficiently liquid-permeable, it can preferably have a coarsely meshed construction by means of a web-like and/or or lattice-like structure.

A further method for achieving the object stated at the outset is a method for the treatment, in particular the drying, of laundry, with the laundry being transported in a spread-out state on a conveyor through at least one drying section, characterized in that the laundry is dried successively with a plurality of consecutive drying units. Accordingly, the laundry or laundry items are dried one after the other by a plurality of successive drying units. The laundry items are thus dried step-by-step or in gradual phases. Furthermore, the number and/or the type of successive drying units can be adapted as needed, in particular with respect to drying intensity and to the type or material of the laundry items.

It is preferably provided that each drying unit forms a drying strip which runs transversely to the direction of transport of the at least one conveyor which carries the spread-out laundry. As a result, the laundry items are dried by each drying unit continuously, completely and/or gap-free across their entire width, preferably across the working width of the conveyor.

One refinement of the method provides that at least one drying unit is provided which differs in its type from other or all remaining drying units.

The employed drying units can be hot air generators, infrared radiators, above all hot air nozzles, and/or drying units which generate shock waves or bursts of pulses. All successive drying units may be of the same type. However, it is preferable that at least one drying unit is of a different type than one or more of the other drying units. Thus, it is conceivable to employ drying units of different types for the consecutive drying of the laundry items. The drying procedure can therefore be selectively conducted as needed. In addition, the drying process can be made in an energy-efficient manner.

Due to the fact that the laundry items lying on the conveyors are transported for drying by at least one conveyor past the drying units in a preferably continuous fashion, the conveyor is employed for linking the individual and successive drying units to one another. The laundry items to be dried are therefore dried during the entire drying process in a spread-out state on the conveyor, in particular on its preferably at least air-permeable upper strand. During the drying process, the laundry items themselves do no need to be moved; instead they are moved continuously by the conveyor step-by-step along the drying units in the same unchanged/unmoved lying state.

An advantageous embodiment of one type of the drying units provides for supplying nozzles of this at least one drying unit with ambient air and/or waste heat from preferably a laundry machine. As a result, at least one part of the drying of the laundry can be carried out self-sufficiently, in other words without any additional energy expenditure. Instead, recycled thermal energy is employed for drying in at least the one drying unit operating with air nozzles. This results in improved energy efficiency in the drying procedure.

In an advantageous further refinement of the method, provision is made for conducting a disinfection, in particular a dry disinfection, of the laundry items during drying, before drying and/or after drying. For example, this may be a plasma-enhanced disinfection which can be carried out in a dry state and which therefore does not result in any introduction of dampness in the at least partially dried laundry.

Another possible embodiment of the method provides for determining the residual moisture and/or temperature of the laundry by means of at least one sensor directed toward the laundry to be dried. The residual moisture and/or the temperature of the laundry is preferably measured by a contactless sensor, for example an infrared sensor or an infrared camera. The at least one measured value, which is preferably determined continuously or at regular successive intervals, allows one to make conclusions about the degree of dryness of the laundry. The method can be correspondingly regulated, for example by altering the drying intensity of the laundry by means of the individual drying units and/or by altering the transport speed of the laundry through the dryer, that is to say as it passes through the successive drying units. It is also conceivable to use the measured results to turn individual drying units off or on.

It is conceivable, depending on the material of the laundry, in particular the type of fabric being treated, to turn on the drying units used for drying this kind of laundry in a targeted manner and to turn off the other drying units temporarily.

A device for achieving the object stated at the outset is a device for the treatment, in particular the drying, of laundry having at least one conveyor with an upper strand by means of which the spread-out laundry can be transported in the treatment direction for drying, characterized in that a plurality of separate, spaced-apart independent drying units following one another in the treatment direction are arranged above the upper strand. In this device, provision is made to arrange above the upper strand of at least one conveyor a plurality of separate and spaced apart independent drying units which are arranged in succession in the drying direction. The conveyor thus assumes a linking function in that it the transports the laundry items to be dried past the different drying units one after the other. It is therefore possible to dry the laundry items individually depending on their special type, in particular their material, in that preferably only those drying units are operated which are appropriate and/or most efficient for the laundry at hand to be dried and/or by varying the intensity of the drying unit.

Preferred are drying units configured as hot air generators, infrared radiators, hot air nozzles and/or shock wave generators. Such drying units exhibit different characteristics and have a different impact on the laundry such that the laundry can be optimally dried by the targeted operation of selective drying units appropriate for the material of the laundry.

The at least one conveyor of the dryer has at least one conveyor belt driven in rotation, which is made of at least one air-permeable material so that the hot air, air jets and/or shock waves directed at the laundry items from the drying units can penetrate the spread-out laundry items and the at least one conveyor belt of the conveyor, with the result that the hot air, the jets and/or the shock waves can penetrate the laundry unimpeded by the conveyor belt of the conveyor.

In a possible refinement of the device, it is provided that at least one sensor, or also a plurality of sensors if required, are arranged preferably above the upper strand of the at least one conveyor for the preferably contactless determination of the degree of dryness, the temperature and/or the residual moisture of the laundry. Based on the measured values so obtained, the drying process can be controlled or regulated depending on the actual drying state. In particular, the transport velocity of the least one conveyor along the drying unit can be adapted individually to the current laundry items to be dried. Furthermore, it is also additionally or alternatively possible, based on the measurements of the at least one sensor, to control the intensity of the drying units and/or to temporarily turn one or more of the drying units on or off.

A further method for the treatment of laundry or laundry items is a method for the treatment, in particular the wet treatment and drying, of laundry which is washed and rinsed in the course of wet treatment and that during the drying phase the bound liquid from the wet treatment is extracted to at least a large extent, characterized in that wet treatment and drying are conducted on laundry lying on at least one conveyor in a spread-out state. Accordingly, it is provided to conduct the wet treatment and drying of the laundry items as they lie in a spread-out state on the at least one conveyor. Thus, the wet treatment and the drying process are equally conducted on an continuous basis, specifically as the laundry items pass through the region of wet treatment and drying.

During their wet treatment and drying, the laundry items lie unmoved on the at least one conveyor, which moves them through the wet treatment and drying regions.

The laundry items are dried following the wet treatment, with preferably all laundry items passing through the wet treatment and drying region at the same speed. This involves the complete treatment, specifically at least the washing, rinsing and drying procedures, and, if applicable, also at least one disinfection process, conducted directly in succession along a conveying section formed by at least one conveyor which extends through the wet treatment and drying region. In contrast to the prior art, with this method according to the invention there is no need to reload the laundry items from a wet treatment device, for example a washing machine, to a dryer.

The drying of the laundry or laundry items is preferably conducted immediately following their wet treatment, in particular the rinsing operation. The laundry items are thus transported or conveyed lying in their spread-out state not only through the wet treatment region but also through the immediately following drying region.

Provided by a preferred refinement of the method is that the wet treatment, in particular the washing and rinsing procedures, and the following drying process are conducted using a plurality of consecutive conveyors. The conveyors immediately follow one another, thus forming a continuous transport section.

The transport speed of the conveyors in the wet treatment region and in the region of drying is expediently coordinated, for example synchronized, with one another. The washed and rinsed laundry items, which may also have been disinfected, are thus transported in an uninterrupted passage through the wet treatment region and the drying region, in particular at the same transport speed. The laundry items remain spread out on the conveyor in a spread-out state even when they are further transported by a plurality of successive conveyors.

A further refinement of the method provides for transferring the dried laundry items in their spread-out state from the conveyor in the region of the dryer directly to a feed conveyor of a downstream laundry treatment unit, preferably a folding machine or a mangle. Such a transfer is expedient because due to the wet treatment and drying of the laundry items in the spread-out state, they maintain this a spread-out extended state at the end of the dryer which is necessary for further processing by a folding machine or a mangle in particular. If necessary, the feed conveyor of the following laundry treatment device can be dispensed with in that its function is assumed by the end of the conveyor which transports the laundry items through the drying zone.

It is furthermore conceivable that the laundry items are placed in their extended or spread-out state on the start of the conveyor in the region of wet treatment. This can be done manually or also with the aid of a feeding machine as customarily employed with mangles, for example. Consequently, the laundry items can be automatically placed on the start of the conveyor individually and in a spread-out state for the purpose of transporting the laundry items through the wet treatment region and the dryer.

The previously described method can in particular be integrated in a processing line for feeding the laundry items for wet treatment and the further treatment of the laundry items after being dried, for example for folding and/or to a mangle. For that reason such an integrative feature can be realized in a particularly simple and advantageous manner because the laundry items are subjected to wet treatment and drying lying in a spread-out state on the conveyor. The laundry items are generally processed further in the same state, in particular mangled and/or folded. The feeding of spread-out laundry items to the conveyor in the wet treatment region is also particularly simple using the available feeding devices, but can also be simply carried out manually by service operators stationed before the wet treatment conveyor.

Conceivable refinements of the method for wet treatment are recited in the features of the claims. The method for drying can be further developed pursuant to the features of the claims.

A further device for achieving the object stated at the outset is a device for the treatment, preferably wet treatment, of laundry having a washing device with a dryer, characterized in that the washing device and the dryer directly follow one another and form a treatment section along which the laundry, spread-out in a lying and/or resting state, can be further transported in the treatment direction by at least one conveyor. This device serves for the preferably simultaneous washing and drying of the laundry or laundry items. For this purpose, the dryer immediately follows the washing device. In the washing device as well as in the dryer the laundry items lie in the spread-out state on an upper strand of a single common conveyor or on upper strands of immediately consecutive conveyors for the formation of a common, continuous conveying section. The conveying section thus connects the washing device and the dryer so that the laundry items can be transported continuously on the conveying section through the washing device and the dryer.

This is carried out preferably on a continual basis according to the continuous flow principle. Here the conveying section links the washing device to the downstream dryer. In addition, the laundry items can be subjected to wet treatment as well as drying in the spread-out and/or resting state on the conveying section, in particular on at least one upper strand of same.

An advantageous further embodiment of the device provides that a feeding machine is arranged upstream of the washing device which transports the spread-out laundry items directly to the start of the conveyor for the washing device. If appropriate, this conveyor can be part of the feeding machine. Due to this design of the device, a linkage of the input/feeding machine with the washing device and the dryer is created for the formation of a continuous processing section or processing line of the laundry or laundry items.

As an alternative, it is also conceivable that the conveyor of the washing device has at its start a loading region on which the spread-out laundry items can be laid, preferably on the upper strand of the conveyor. As a result, the laundry items can be spread out on or transferred to the upper strand of the conveyor of the washing device without a feeding machine device.

Another further possible embodiment of the device is that the laundry items dried in the dryer can be fed by the conveyor directly to a following laundry treatment unit, in particular a folding machine or a mangle. Since the laundry items are washed and dried as they lay upon at least one conveyor in the spread out state, they are already in the state required for mangling or folding in that they are already spread out or extended.

Advantageous embodiments of the device for washing the laundry items are recited in the claims.

Further possible embodiments of the device for drying the laundry items are recited in the dependent claims.

BRIEF DESCRIPTION OF THE DRAWINGS

Preferred exemplary embodiments of the invention will be described below in more detail on the basis of the drawing, in which.

DETAILED DESCRIPTION OF PREFERRED EMBODIMENTS

The devices shown in the figures are employed for the treatment of laundry, in particular separate items of laundry. The laundry items are preferably so-called flat textiles, such as tablecloths, napkins, duvet covers, pillow cases and bed sheets.

Figure 1:
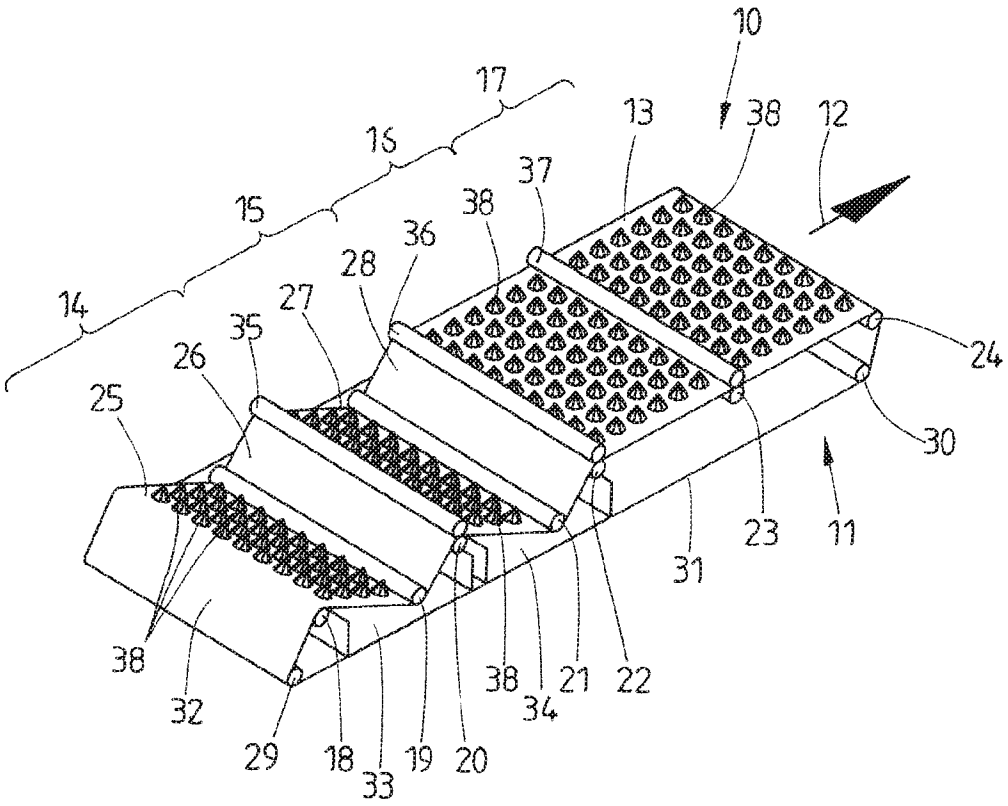
FIG. 1 shows a schematic perspective view of a device for the wet treatment of laundry.
Figure 2:
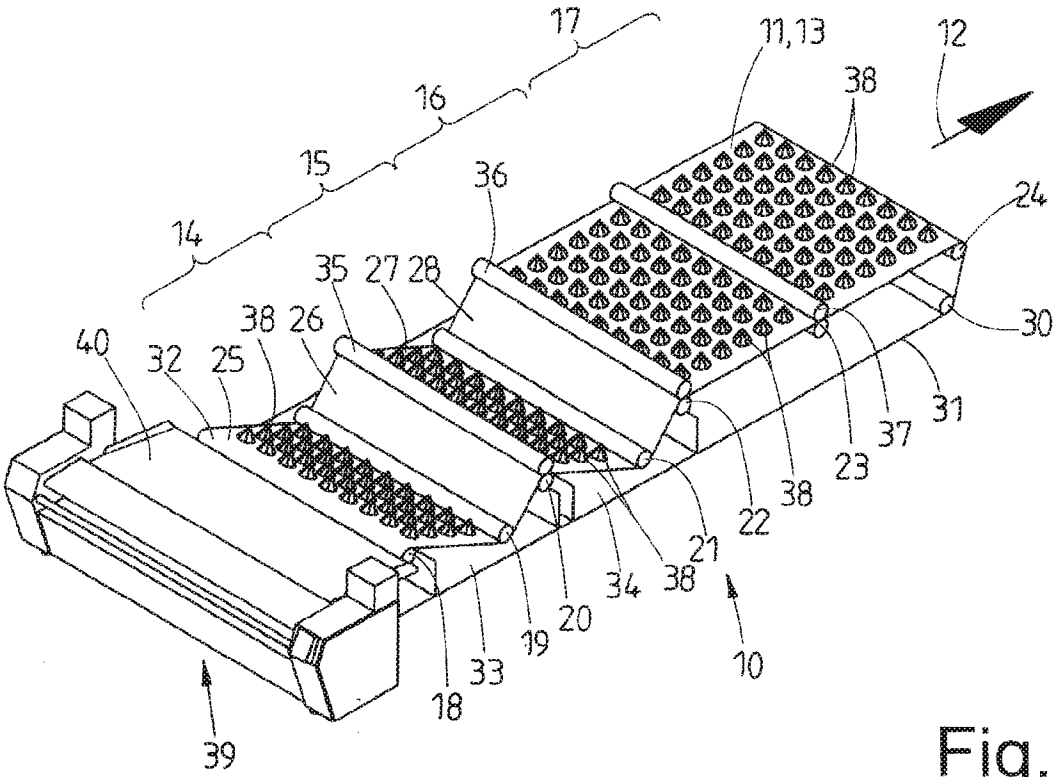
FIG. 2 shows the device of FIG. 1 with an upstream feeder station.

The device of FIGS. 1 and 2 is employed for the wet treatment of laundry items, specifically for their washing and/or rinsing and/or disinfection. In the following, this device will be referred to a washing device 10.

The washing device 10 has a single continuous conveyor, which in the shown exemplary embodiment is a belt conveyor 11. The belt conveyor 11 is driven in rotation with an upper strand 13 moving along in the treatment direction 12. A conveyor belt of the belt conveyor 11 extends across the entire working width of the washing device 10. The conveyor belt is liquid-permeable in that it is provided with a web-like or lattice-like structure.

The shown washing device 10 has a plurality of uninterrupted treatment zones following each other in the treatment direction 12, specifically a pre-wash zone 14 at the start of the washing device 10, followed by a main wash zone 15 which serve to wash the laundry items. Directly following the main wash zone 15 is a process water rinse zone 16 as well as a fresh water zone 17. Together they form a rinse zone. The process water rinse zone 16 can eliminated if appropriate, with the rinsing operation taking place only in a rinse zone.

A disinfection of the laundry items can be conducted in the rinse zone or following the rinse zone.

It is conceivable that a disinfection zone (not shown) is located between the main wash zone 15 and the process water rinse zone 16. In the disinfection zone, the laundry items can be disinfected chemically after washing, in other words when they are damp, and/or by means of plasma jets and/or peracetic acid.

The laundry items lying spread out on the upper strand 13 of the belt conveyor 11 are transported continuously one after the other by the single belt conveyor 11 through the individual zones of the washing device 10.

The upper strand 13 of the belt conveyor 11 is guided at a distance in the treatment direction 12 around a plurality of successive deflection drums 18 to 24, of which at least one also serves as a driver drum. The deflection drums 18, 20, 22, 23 and 24 lie in a common, preferably horizontal plane. The deflection drums 19 and 21 lie in lower common plane which runs parallel to the upper plane having the deflection drums 18, 20, 22, 23 and 24. As a result, the upper strand 13 in the region of the prewash zone 14 and the main wash zone 15 has only one V-shaped course (as seen from the side) with a lower vertex that is defined by the deflection drums 19 and 21. The lower deflection drum 19 of the prewash zone 14 lies between the deflection drums 18 and 20. Likewise, the lower deflection drum 21 of the main wash zone lies between the deflection drums 20 and 22. As a result, the upper strand 13 and the prewash zone 14 has an initial section 25, which slopes downwards in the treatment direction 12, and a following, rising section 26. The upper strand 13 also has in the region of the main wash zone 15 an initial section 27 that slopes downward followed by a rising section 28, which is situated at the end of the washing zone. In the shown exemplary embodiment, sections 25 and 27, on one hand, as well as 26 and 28, on the other hand, are configured to have a different lengths in that sections 26 and 28 are shorter than the sections 25 and 27, whereby it is possible that sections 25 and 27, on one hand, and sections 26 and 28, on the other hand, can in turn have the same length. But it is conceivable to provide the individual sections 25 to 28 with lengths that deviate from the shown exemplary embodiment.

Two further deflection drums 29 and 30 lead to or from the beginning and the end of a lower strand 31 of the conveyor belt of the belt conveyor 11. As a result, the lower strand 31 runs in a preferably horizontal plane. The plane of the lower strand 31 lies at a distance below the plane formed by the deflection drums 19 and 21. The lower deflection drum 29 at the front end of the belt conveyor 11 of the washing device 10, as seen in the treatment direction 12, is arranged below and upstream of the deflection drum 18, as seen in the treatment direction 12. Opposite thereto lies the rear and lowest deflection drum 30 at a distance below the deflection drum 24 at the rear end of the upper strand 13.

As a result of the deflection drum 29 lying upstream and below the deflection drum 18 at the beginning of the washing device 10, an upward sloping loading section 32 of the conveyor belt of the belt conveyor 11, as seen in the treatment direction 12, is created between the deflection drums 18 and 29.

A collecting trough 33 for prewash liquid is located between sections 25 and 26 of the upper strand 13 disposed in the prewash zone 14 and the lower strand 31. Also located in the region of the main wash zone 15 between sections 27 and 28 of the upper strand 13 and the lower strand 31 is a separate collecting trough 34 for the main wash liquid. In order to provide sufficient space between the upper strand 13 and the lower strand 31 of the belt conveyor 11, the deflection drums 29 and 30 which form and guide the lower strand are arranged at a sufficiently vertical distance below the deflection drums 19 and 21 of the upper strand 13.

In the shown washing device 10, squeegee rollers or pairs of squeegee rollers are assigned to the upper strand 13 of the belt conveyor 11 in the wash zone as well as in the rinse zone. The deflection drums 19 and 21, which buckle the upper strand 13 downwards in the region of the prewash zone 14 and main wash zone 15, form by themselves squeegee rollers, under which the upper strand 13 runs along with the spread-out laundry items lying on it. In the process and as a result of the upper strand 13 being pressed by tension against the deflection drums 19 and 21, the respective laundry item is pressed together between the relevant deflection drums 19 and 21 and the upper strand 13, with a portion of the liquid from the washing cycle bound in the respective laundry item being extracted.

The deflection drums 20 and 22 at the end of the prewash zone 14 and the main wash zone 15 are each assigned a squeegee roller 35, 36. The squeegee rollers 35 and 36 lie above the upper strand 13, specifically spaced by the upper strand 13 above the deflection drums 20 and 22. At the end of the prewash zone 14, the upper strand 23 with the spread-out laundry items on it runs between the squeegee roller 35 and the deflection drum 20 and at the end of the main wash zone 15 between the squeegee roller 36 and the deflection drum 22. As a result, at least a portion, in particular a major portion, of the liquid bound in the laundry items, namely the bound liquor, is also separated from the laundry items upstream of the main wash zone, on one hand, and upstream of the rinse zone, on the other. The liquid separated from the laundry items is collected in collecting troughs 33 and 34, specifically the prewash liquid in the collecting trough 33 under the prewash zone 14 and the main wash liquid in the collecting trough 34 under the main wash zone 15. It is also conceivable to provide a smaller number of dewatering stages in the course of the wash zone, for example only the squeegee roller 36 at the end of the main wash zone 15.

The deflection drums 19 and 21 of the upper strand 13 of the belt conveyor 11 are positioned at such a low point in the prewash zone 14 and the main wash zone 15 that they dip into the prewash liquid or main wash liquid collected in the collecting troughs 33 and/or 34 with the sections of the upper strand 13 located in their vicinity. As a result, the spread-out laundry items resting on the upper strand 13 are dipped into the liquid in the collecting troughs 33 and/or 34 and transported through the latter as they are further conveyed by the belt conveyor 11.

The treatment liquids collected in the collecting trough 33 of the prewash zone 14 and/or in the collecting trough 34 of the main wash zone 15 can be led back to the beginning of the prewash zone 14 and/or the main wash zone 15 against the washing direction through a recirculation tube (not shown in the figures). After being filtered if necessary or subjected to some other processing step, the main wash liquid and/or prewash liquid is directed back to the nozzles for spraying the laundry item and is thereby recycled.

In the shown washing device 10 the rinse zone has a squeegee roller 37 between the process water rinse zone 16 and the fresh water zone 17 and arranged above the deflection drum 23. The upper strand of the belt conveyor 11 with the laundry items resting on it runs between the deflection drum 23 and the squeegee roller 37 lying above the upper strand 13. A large portion of the rinse liquid from the process water rinse zone 16 is thus separated from the laundry items upstream of the fresh water rinse zone 17. If appropriate, another squeegee roller can be arranged above the rear deflection drum 24 downstream of the fresh water rinse zone 17 in order to separate a large portion of the rinse liquid out of the fresh water rinse zone 17 from the laundry items before the latter are dried.

Liquid nozzles, specifically high pressure nozzles, are situated in the wash zone as well as in the rinse zone above the upper strand 13 of the belt conveyor 11 and the laundry items lying upon it. Washing and rinsing liquid are dispensed from them at high velocity and high pressure. In FIG. 1 only the liquid jets dispensed from the high pressure nozzles are shown, specifically in the shown exemplary embodiment as full-surface liquid cones 38. As an alternative, the high pressure nozzles can be configured to form flat jets or hollow stream jets, for example liquid cones. Flat jets having a triangular shape extend with their long axis (greater width) transverse to the treatment direction 12.

In the shown washing device 10 the high pressure nozzles are assigned to the respective sections 25 and 27 of the prewash zone 14 and main wash zone 15 as well as to the entire process water rinse zone 16 and fresh water rinse zone 17. The high pressure nozzles are arranged, preferably in a stationary manner, at a distance above the corresponding sections of the upper strand 13. This distance is at least large enough for the spread-out laundry items lying on the upper strand 13 to be transported by the belt conveyor 11 under the high pressure nozzles without making contact with them.

In the exemplary embodiment of FIGS. 1 and 2, the high pressure nozzles are distributed in a uniform grid pattern across the sections 25 and 27 of the wash zone and across the entire rinse zone. Here a plurality of rows follow one another in the treatment direction 12 with adjacent high pressure nozzles lying transversely to the treatment direction 12. The spacing of the rows of high pressure nozzles is preferably just as large as the spacing between the high pressure nozzles in the respective row. This results in a uniform grid pattern, with the high pressure nozzles of successive rows being alternately positioned at the preceding row spaces in that the high pressure nozzles of the second row are positioned between the high pressure nozzles of the first row. There are enough high pressure nozzles arranged adjacent to one another with a selected spacing between them such that the impact area of the liquid cones 38 generated by the high pressure nozzles on the top side of the laundry items lying spread-out on the upper strand 13 is so large that the laundry items can be completely covered by the washing or rinsing liquid dispensed from the high pressure nozzles by the high pressure nozzles of at least two successive rows across the entire working width of the belt conveyor 11. As a result, the laundry items lying on the upper strand 13 can be sprayed or sprinkled by the liquid dispensed from the high pressure nozzles across their entire surface.

The high pressure nozzles generate liquid jets at such a pressure and velocity that is sufficient to penetrate the laundry items lying on the upper strand 13 with liquid, wherein excess liquid flows through the upper strand 13 of the belt conveyor 11 and can accumulate in the collecting troughs 33 and 34. The same applies to the process water rinse zone 16 and the fresh water rinse zone 17. Here the liquid flowing through the upper strand 13 can also be caught under the upper strand 13 by one or more collecting troughs (not shown) in a different manner.

The laundry items are preferably more intensely sprayed with wash liquid in the wash zone than in the rinse zone. In the rinse zone, a sprinkling with rinse liquid, preferably a high pressure sprinkling, can be sufficient.

It is conceivable to determine the loading of the upper strand 13 with spread-out laundry items preferably at the beginning of the wash zone and to control the high pressure nozzles such that essentially only the laundry items are treated with treatment liquid on their full surface but that liquid jets from the high pressure nozzles are not applied in any appreciable amount to the areas on the upper strand 13 that are free of laundry items.

Particularly in the case of the washing device 10 shown in the figures, no high pressure nozzles are assigned to the higher running sections 26 and 28 of the upper strand 13 in the prewash zone 14 and in the main wash zone 15. These sections 26 and 28 of the upper strand serve as sections where excess liquid can drip off the laundry items at the end of the prewash zone 14 and the main wash zone 15. The dripped off liquid can be caught by the respective collecting troughs 33 and 34.

It is conceivable to mount the nozzles of each row at a uniform distance on or in tubes which run transversely to the treatment direction 12 and which are simultaneously employed to supply water to the nozzles. In the case of high pressure nozzles mounted on tubes, it is possible to configure the tubes, in particular sections thereof, between two adjacent high pressure nozzles as pressure runners which come to rest upon the spread-out laundry items lying on the upper strand 13 of the belt conveyor 11 and temporarily fix the latter on the upper strand 13 while they are being treated by the high pressure jets released by the high pressure nozzles.

It is also possible to provide outer cone-shaped shields for the liquid cones 38 below or on the nozzles. As a result, the liquid dispensed by the respective high pressure nozzle can be limited to a targeted circular area of the cone shield, which is open at the bottom, of the liquid cone 38. In the case of nozzles having a different shape, for example flat nozzles or hollow cone nozzles, the high pressure nozzles can be assigned with correspondingly shaped shields.

The open bottom side of the shields arranged in a fixed position under the high pressure nozzles can, as an alternative or in addition to the previously described pressure runners, come to rest on the spread-out laundry items lying on the upper strand 13 in a flat state in order to also fix and/or tighten and/or stretch the laundry items on the upper strand.

FIG. 2 shows the washing device 10 of FIG. 1 having a feeding machine 39 arranged upstream of the washing device 10 as seen in the treatment direction 12. The laundry items are manually placed along one or two tracks to the track feed conveyor 40 of this feeding machine 39 in the spread-out or stretched-out state and preferably fed to the loading section 32 of the belt conveyor 11 of the washing device 10, or preferably larger laundry items automatically transferred along one or two tracks to a spreading device of the feeding machine 39, which spreads the laundry items and places them in the spread-out state on the feed conveyor 40, which then transfers the spread-out laundry items to the loading section 32 of the belt conveyor 11 of the washing device 10, for example.

The method according to the invention is conducted with the washing device 10 of FIGS. 1 and 2 as follows:

The laundry items are placed in their spread-out state either manually directly on the loading section 32 of the belt conveyor 11 along one or two tracks, or are automatically transferred to the loading section 32 of the belt conveyor 11 by the feed conveyor 40 of the feeding machine 39 in the spread-out state.

The laundry items lying in a spread-out state on the upper strand 13 of the belt conveyor 11 are continuously transported by the belt conveyor 11 toward and through successive treatment zones of the washing device 10. The wet treatment of the laundry items in the washing device 10 is conducted as the laundry items lie in a spread-out state on the upper strand 13. The laundry items are continuously transported step-by-step through the successive treatment zones of the washing device 10 according to the run-through process.

In the prewash zone 14 adjacent liquid cones 38 are generated in a uniform grid across the section 25 of the upper strand 13 in a plurality of successive rows. This results in a full-surface spraying and/or sprinkling of the laundry items with high-velocity liquid jets propelled under high pressure. These liquid jets penetrate the laundry items, washing out dirt from the laundry items. The liquid and the entrained dirt flow through the upper strand 13 of the liquid-permeable configured conveyor belt of the belt conveyor 11 and are caught in the collecting trough 33.

After passing the grid of high pressure nozzles, at least part of the liquid still bound in the laundry items is pressed out of the laundry items by the lower deflection drum 19. This liquid passes through the liquid-permeable upper strand 13 and accumulates in the collecting trough 33. Additional liquid can drip from the laundry items along the following rising section 26 of the upper strand 13 and accumulate in the collecting trough 33. At the end of the prewash zone 14 a further portion of the liquid still bound in the laundry items and containing dirt is removed from the laundry items between the squeegee roller 35 and the deflection drum 20, namely pressed out of the laundry items. This liquid also accumulates in the collecting trough 33 in the region of the prewash zone 14. This concludes the prewashing process.

In the region of the main wash zone 15, the liquid cones 38 generated by a grid comprising a plurality of high pressure nozzles spray and/or sprinkle main wash liquid in an uniform pattern over the section 27 of the upper strand 13 onto the full surface area of the laundry items which are located in the region of this section 27. Here, too, the laundry items are sprayed with highly pressurized liquid at a great velocity, with the liquid penetrating the laundry items, passing through the upper strand 13 and accumulating in the collecting trough 34 assigned to the main wash zone 15. After a portion of the liquid bound in the laundry with the adhering dirt has been removed at the deflection drum 21, the laundry items are transported upwards on the ascending section 28 of the upper strand 13 to the end of the main wash zone 15. Here is where a further portion, preferably a major portion, of the bound liquor is pressed out of the laundry items between the squeegee roller 36 and the deflection drum 22 opposite thereto. As a result, the laundry items arrive at the following rinse zone with merely a minimal portion of wash liquid bound in them.

It is also conceivable, that is spread out laundry items lying on the upper strand 13 are dipped in the treatment liquid in the region of the lower deflection drums 19 of the prewash zone 14 and the lower deflection drum 21 in the region of the main wash zone 15 and are drawn through the prewash liquid in the collecting trough 33 and/or the main wash liquid in the collecting trough 34 by the rotationally driven conveyor belt of the belt conveyor 11. Because the laundry items also run between the deflection drum 19 and/or 21, the prewash and/or main wash liquid is pressed through the laundry items by the deflection drums 19 and 21. The results in a more intensive prewashing and/or main washing process.

The pre-washing liquid caught in the collecting trough 33 and/or the main wash liquid caught the collecting trough can be recycled. To this end, the prewash and or main washing liquid can be transported back against the treatment direction from the respective collecting trough 33, 34 by a corresponding pipe system, and following any necessary processing, in particular filtering, again fed back to the nozzles for spraying and/or sprinkling the laundry items. This results in a multiple use of the washing liquid. It is preferably provided that only the main wash liquid from the collecting trough 34 is returned to the prewash zone 14 so that the less dirty main wash liquid can be reused for the prewash.

The washed laundry items that have been largely freed from the bound washing liquid and dirt are rinsed in the rinse zone. To this end, a rinsing process is conducted in the process water rinse zone 16 with process water, in other words with liquid that has already been used for other means. The rinsing process is in principle conducted according to the same principle as the previously described washing procedure, with the laundry being sprayed across its entire surface with rinsing liquid by a grid of liquid cones 38, preferably with liquid from high pressure nozzles.

The rinsing in at least the process water rinse zone 16 can also be conducted with liquid jets of high velocity and high pressure, wherein the velocity and the pressure of the rinse liquid, if necessary, can in the following fresh water rinse be less than that employed for washing. It is also conceivable to use other nozzles for rinsing than liquid cones 38, for example spray nozzles, above all high pressure spray nozzles Arranged at the end of the process water rinse zone 16 is a pair of squeegee rollers that comprises an upper squeegee roller 37 and a lower deflection drum 23 opposite thereto, which thereby assumes a multiple function, namely not only serving to guide the upper strand 13 but also to form a pair of squeegee rollers. At least a major portion of the liquid bound in the laundry items from the process water rinse cycle is removed at the end of the process water rinse zone 16 by the squeegee roller 37 and the deflection drum 23 assigned to it. As a result a major portion of the process water liquid is removed from the laundry items prior to the following fresh water rinse zone 17.

The laundry items in the fresh water rinse zone 17 are in principle rinsed in exactly the same manner as in the process water rinse zone 16. Instead of process water, fresh water is used for the final rinsing. The rinsing process in the fresh water rinse zone 17 can be performed with liquid jets that are less energetic and preferably weaker and/or by merely applying a sprinkling process. After the laundry has been rinsed with fresh water, the wet treatment stage of the laundry items is concluded. Before the laundry items are further processed, is may be also provided that a portion, preferably a major portion of the liquid still bound in the laundry from the fresh water rinsing process items is removed now or only at the end of the fresh water rinse zone 17. This can again be performed by squeegee rollers in that a squeegee roller (not shown in FIGS. 1 and 2) is arranged above the rear deflection drum 24, or as an alternative also by pneumatic means using so-called "air knives".

If necessary, the laundry is disinfected during the washing process, preferably during the main wash or at the end of the main wash zone. This disinfection is performed in an ultrasonic bath with a mixture of at least water, preferably sterilized water, and peracetic acid. The water contains only a small amount of peracetic acid so that the ultrasonic bath employed for disinfection contains only a low concentration of peracetic acid.

The disinfection bath is set in ultrasonic oscillations by an ultrasound source, for example a sonotrode. For disinfection the laundry is transported through the disinfection bath that has been set in ultrasonic oscillations. There a rapid and effective disinfection of the laundry is performed in the oscillating disinfection bath having a low peracetic acid concentration of preferably 0.04% to 2%. The ultrasonic oscillations result in a hydrodynamic-acoustic gravitation of the laundry in the disinfection bath which enhances the efficacy of the peracetic acid in the disinfection bath, thus making it possible to achieve an effective, in particular thorough, disinfection at a lower peracetic concentration and/or with a shorter length of time spent by the laundry in the disinfection bath set in ultrasonic oscillations.

The method described above allows for the wet treatment, specifically the washing, rinsing and, if necessary, the disinfection, of the spread-out laundry items resting on the upper strand 13 of the belt conveyor 11, with the laundry items only being moved by the upper strand 13, which runs continuously in the treatment direction 12, and passing under the stationary nozzles or high pressure nozzles arranged above the belt conveyor 11 and the laundry items lying on the latter and moved under the liquid jets generated by the latter.

The method according to the invention is characterized in that a portion, in particular a major portion, of the treatment liquid is extracted from the laundry items at the end of the prewash zone 14, the main wash zone 15 and preferably also the process water rinse zone 16 before they are further treated in the next step. This results in the greatest degree of separate baths possible. Only a small amount of treatment liquid is carried over from one zone to the other.

Due to the squeegee rollers 35, 36 at the end of the prewash zone 14 and main wash zone 15, a substantially complete bath separation is realized between the prewash and main wash. Since the separated treatment liquid from the prewashing and main washing steps are accumulated in the separate collecting troughs 33, 34, no carryover of bath liquid occurs.

By virtue of the squeegee roller 37 between the process liquid rinse zone 16 and the fresh water zone 17, any carryover of rinse liquid in the rinse zone is also avoided to at least a great extent.

Figure 3:
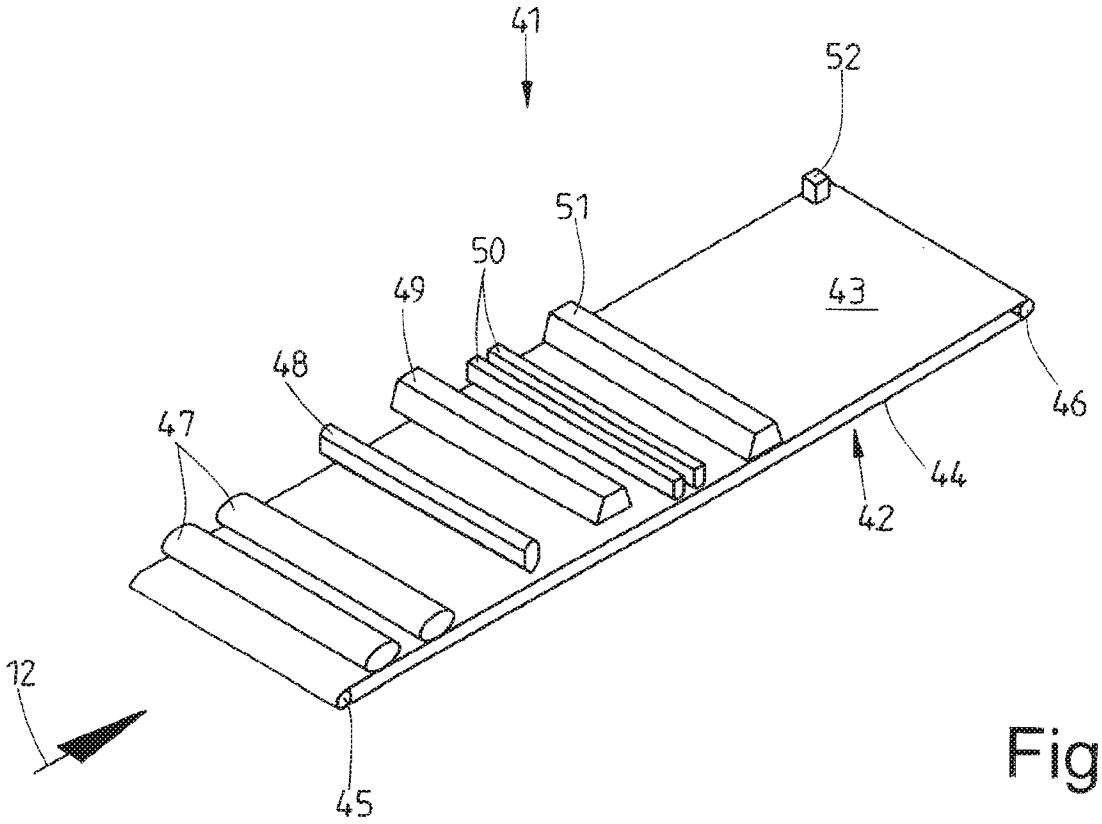
FIG. 3 shows a schematic perspective view of a device for the drying of laundry.
Figure 4:
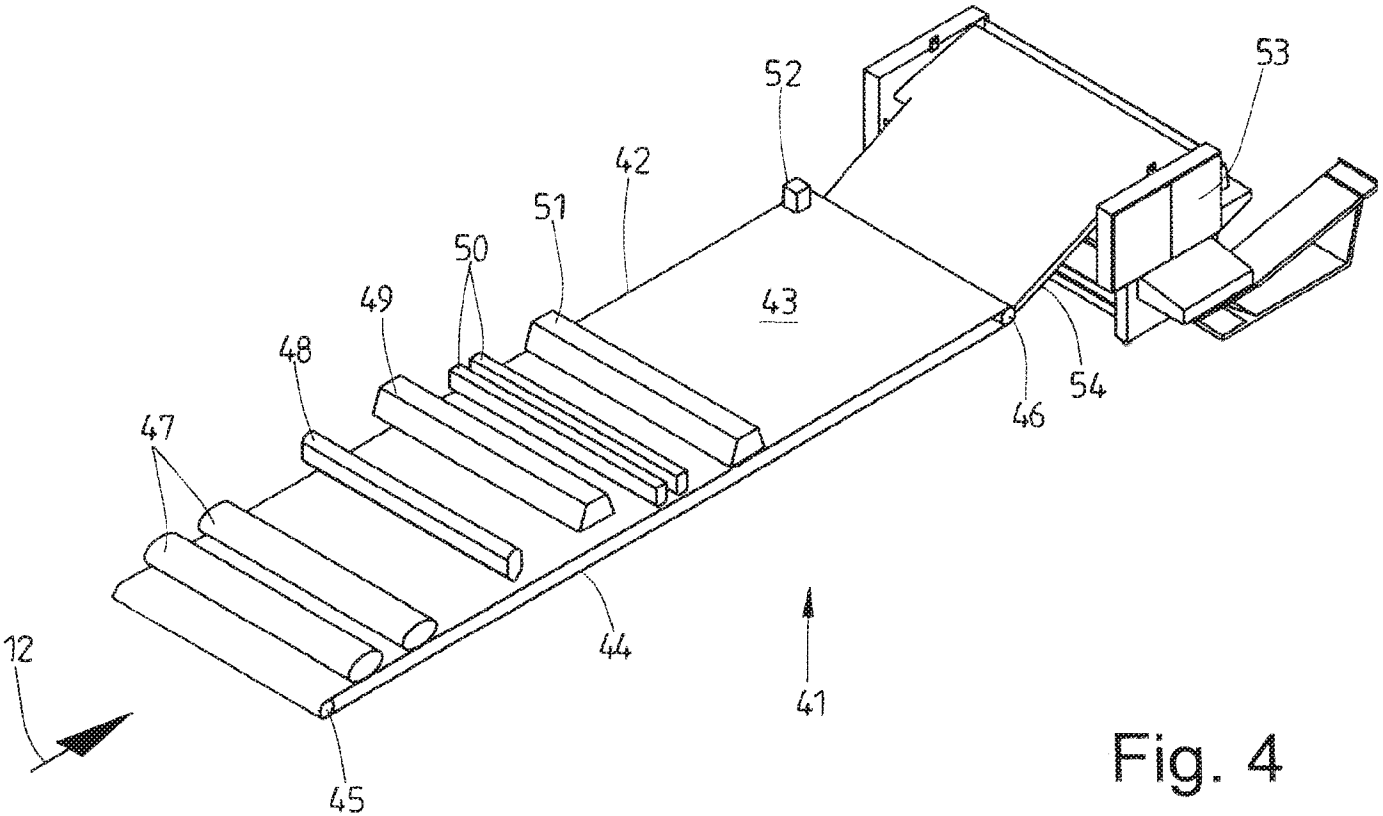
FIG. 4 shows the device of FIG. 3 with a downstream folding machine.

FIGS. 3 and 4 show a device configured as a dryer 41 for the purpose of drying laundry or laundry items. The laundry items are primarily flatware items. In particular, the dryer 41 is employed to dry laundry items that have been washed and rinsed with the washing device 10 and also disinfected if necessary.

The dryer 41 has a conveyor extending through the entire drying section, preferably a belt conveyor 42. The belt conveyor 42 also has a conveyor belt extending across its entire working width. Said conveyor belt is at least air-permeable. The circulating conveyor belt of the belt conveyor 42 is preferably driven in a continuous circulatory fashion so that its upper strand 43 moves onward in the treatment direction 12.

During drying, the laundry items lie in the same state on the upper strand 43 of the belt conveyor 42 as during their washing on the upper strand 13 of the belt conveyor 11 of the washing device 10. In other words, the laundry items are also dried in the dryer 41 in the stationary and spread-out state they assumed on the upper strand 13.

The upper strand 43 of the dryer 41 runs in a rectilinear manner in that it lies in a plane with runs preferably horizontally. Located below at a parallel distance is a lower strand 44 of the dryer 41. Accordingly, the endless conveyor belt of the belt conveyor 42 is guided and deflected only by a front deflection drum 45 and a back deflection drum 46. One of the deflection drums 45 or 46 is configured as a drive drum.

Arranged above the upper strand 43 is at least one dryer. The dryer 41 is assigned a plurality of drying units. In the shown exemplary embodiment, these are different drying units. The drying units follow one another in the treatment direction 12 at equal or different spacings. As a result, the drying units are distributed along the upper strand 43. In the shown exemplary embodiment the drying units are assigned to the large front section in the length of the upper strand 43, with the result that no drying units are assigned to a rear part of the upper strand 43 as seen in the treatment direction 12. This section corresponds to a third to a fourth of the length of the upper strand 43 of the belt conveyor 42.

The drying units are arranged at a slight distance above the upper strand 43. This distance is large enough that the drying units do not touch the spread-out laundry items lying or resting on the upper strand 43 of the dryer 41, preferably such that at least in part they maintain a slight distance above the laundry items. The drying units extend across the entire width of the upper strand 43 of the belt conveyor 42. As an alternative, the drying units may have a width corresponding to the working width of the dryer 41. The drying units are then limited to that part of the width of the upper strand 43 on which the laundry items lying on the upper strand 43 may be located.

In the shown exemplary embodiment, but to which the invention is not limited, two preferably identical shock wave applicators 47 are located at the start of the dryer 41 at a slight distance above the upper strand 43. It is also conceivable to provide a greater or smaller number of shock-wave applicators 47. The shock-wave applicators 47 preferably operate with sonic waves, in particular ultrasound.

Following the shock wave applicators 47 is a drying unit formed by a row of air nozzles 48. The distance between the row of air nozzles 48 and the last shock-wave applicator 47 is several times greater than the distance between the individual shock-wave applicators 47. The air nozzles of the row of air nozzles 48 are spaced apart such that they generate a continuous air curtain across the entire working width of the dryer 41 that is directed, preferably vertically, at the laundry items lying on the upper strand 43.

The air nozzles are fed with ambient air or discharge air still having a residual warmth from another drying unit or another laundry treatment device. A blower forces the air with pressure through the air nozzles such that the air jets discharged from the air nozzles are preferably diffuse air jets. These air jets exhibit a high flow speed and therefore impact the laundry items at a high velocity and preferably penetrate the laundry items as well.

The row of air nozzles 48 is followed at a distance by a further drying unit that is configured as a hot air beam 49 which runs continuously and transversely to the treatment direction 12 across the entire working width of the dryer 41.

The hot air beam 49 generates through a row of adjacent hot air nozzles, for example, a hot air curtain extending across the working width of the dryer 41. The hot air curtain has a high velocity and therefore penetrates the laundry items on the upper strand 43 of the belt conveyor 42. The hot air curtain 49 is fed hot air. This can be air heated by a burner, such as a gas burner, an oil burner or some other energy source.

In the shown dryer 41, a disinfection device is provided at a distance behind the hot air beam 49 and which in the exemplary embodiment of FIGS. 3 and 4 has two successive disinfection beams 50 which run transverse to the treatment direction 12 and extend across the entire working width of the dryer 41. As an alternative, only a single disinfection beam 50 can be provided, or more than two disinfection beams 50.

The disinfection beams 50 are designed for the dry disinfection of the laundry items. To this end, the laundry items are radiated by the disinfection beams 50, in particular impacted with energy beams with a high energy density, and completely penetrated. The preferred disinfection beams 50 are those configured for the plasma-enhanced disinfection of the laundry items.

The disinfection beams 50 are followed by at least one drying unit configured as an infrared radiator 51. The infrared radiator 51 can be gas driven. An elongate radiator that extends across the entire working width of the dryer 41, or a plurality of adjacent infrared radiators 51, generate a preferably continuous infrared ray curtain, which impacts with infrared beams the respective laundry item, or in the case of a multi-track operation of the dryer 41, all laundry items lying adjacent to one another at the same time across the entire operating width. The radiated intensity is selected such that the infrared radiation penetrate the spread-out or extended laundry items lying on the upper strand 43 of the belt conveyor 43 and impact the upper strand 43 or pass through the latter due to its at least air-permeable configuration.

It is conceivable to provide a plurality of infrared radiators 51 arranged successively in the treatment direction 12.

The dryer 41 is equipped with at least one sensor for the direct or indirect, preferably contactless, monitoring of the degree of dryness and/or the residual moisture of the laundry items to be dried and/or already dried. For example, the sensor can be used to determine the temperature, in particular the surface temperature, of the laundry items. For this purpose, the at least one sensor can be realized as an infrared sensor 52, for example and infrared camera.

In FIGS. 3 and 4 the infrared sensor 52 is provided at the end of the dryer 41, specifically of its upper strand 43. In FIGS. 3 and 4 the infrared sensor is represented as positioned in the marginal region of the upper strand 43 in order to establish the degree of dryness of the laundry items being transported along below the infrared sensor 52, for example. However, the infrared sensor 52 can also be located at another position in the end region of the upper strand, for example in the middle thereof. For multitrack operations, it is advantageous to provide a row comprising a plurality adjacent infrared sensors 52.

At the end of the drying phase, the at least one infrared sensor 52 determines in a contactless manner the degree of dryness and/or the residual moisture of the respective laundry item as it passes by.

It is also conceivable to provide further sensors, for example infrared sensors 52, along the course of the drying section downstream of some or all drying units. As a result, it is possible to monitor the drying process during the drying phase, for example after each selected drying unit or all drying units.

At the end of the dryer 41 the dried laundry items are transferred to a following laundry treatment device in the state in which they lie on the upper strand 43 of the dryer 41, in other words in a spread-out state. Said treatment device can be a mangle or a folding machine 53 shown in FIG. 4. The dried laundry items can be directly transferred from the upper strand 43 of the dryer 41 to a intake conveyor 54 of the folding machine 53 in their already spread-out state, in other words without requiring any further reorientation.

The method according to the invention is conducted with the dryer in FIGS. 3 and 4 as follows:

The dryer 41 is equipped with a conveyor. The latter is employed for transporting the laundry to be dried continuously along the individual drying units and/or the at least one disinfection device. The dryer 41 is thereby configured as a continuous dryer. The laundry items to be dried lie in a spread-out state on the upper strand 43 of the belt conveyor 42. The laundry items in the resting state are therefore transported through the entire dryer 41 in the treatment direction 12 only by the movement of the conveyor belt of the belt conveyor 42. This occurs in a continuous manner.

The laundry items, spread out on the upper strand 43 in the lying and resting state, are moved bit by bit in the treatment direction 12 past the successive and spaced apart drying units and, if necessary, past the at least one disinfection device by the continuously moving upper strand 43 of the belt conveyor 42. As they are further transported in the treatment direction, the spread-out laundry items lying on the upper strand 43 are preferably moved along continuously under the drying units and, if applicable, the at least one disinfection unit and spaced at a distance from them.

In the shown exemplary embodiment, the laundry items to be dried in the dryer 10 are first moved past the two shock wave applicators 47, then past the at least one row of air nozzles 48, the at least one hot air beam 49, the disinfection beam 50 and the at least one infrared radiator 51, specifically under said devices. In the process, a continual drying of the laundry items takes place and, if necessary, also a disinfection process during the drying phase, preferably a dry disinfection process.

Shown in FIGS. 3 and 4 is merely one possible exemplary embodiment of the dryer 41. Variants of this dryer are possible which exhibit more or less drying units. The sequence and number of the different drying units can deviate from the exemplary embodiment of FIGS. 3 and 4. The at least one disinfection device can also be located at a different location in the dryer. A dryer is also conceivable which has no disinfection device.

The infrared sensor 52 represented in a merely symbolic manner in FIGS. 3 and 4, or a different type of detection means, detects and/or measures the degree of dryness of the laundry items or, as an alternative or in addition, their residual moisture. This measurement is made in particular in a contactless manner and/or at the surface of the dried laundry items.

It is also conceivable to provide at least one infrared sensor 52 or a different detection means not only at the end of the drying section but also between the individual drying and/or disinfection devices along the course of the drying section.

By means of the measured values determined by the at least one sensor for the contactless determination of the residual moisture and/or the degree of dryness of the laundry items it is possible to control or regulate the drying process by altering the intensity of the individual drying units and/or by selectively switching them on or off.

It is also conceivable to dry the laundry items with selected drying units depending on the type of laundry being processed. Drying is then performed only with such drying units that are appropriate or the preferred choice for drying the respective laundry items. It is also conceivable, by turning the disinfection device on or off in a targeted manner, to disinfect only those laundry items which actually require disinfection and/or which are suited for such treatment.

With the measured values determined along the drying section by at least one sensor means for establishing the degree of dryness or the residual moisture in the laundry items, it is possible, by means of the targeted control or regulation of the downstream drying units, to further influence the drying process of the laundry items being handled by subjecting them to a subsequent drying process that is more intense, less intense or even with no further drying process at all.

After drying, the laundry items are further transferred directly to a downstream laundry treatment device, specifically a folding machine 53 in the exemplary embodiment of FIG. 4, in the same state as they were during drying, in other words spread out and resting on the upper strand 43 of the belt conveyor 42 of the dryer 41. This transfer is made preferably to the upper strand of an intake conveyor 54 of the folding machine 53. As a result, the laundry items are placed on the upper strand of the intake conveyor is an initial position that is already appropriate for folding. Thus, the laundry items do not need to be reoriented for the folding process. They are simply folded as they leave the dryer.

Figure 5:
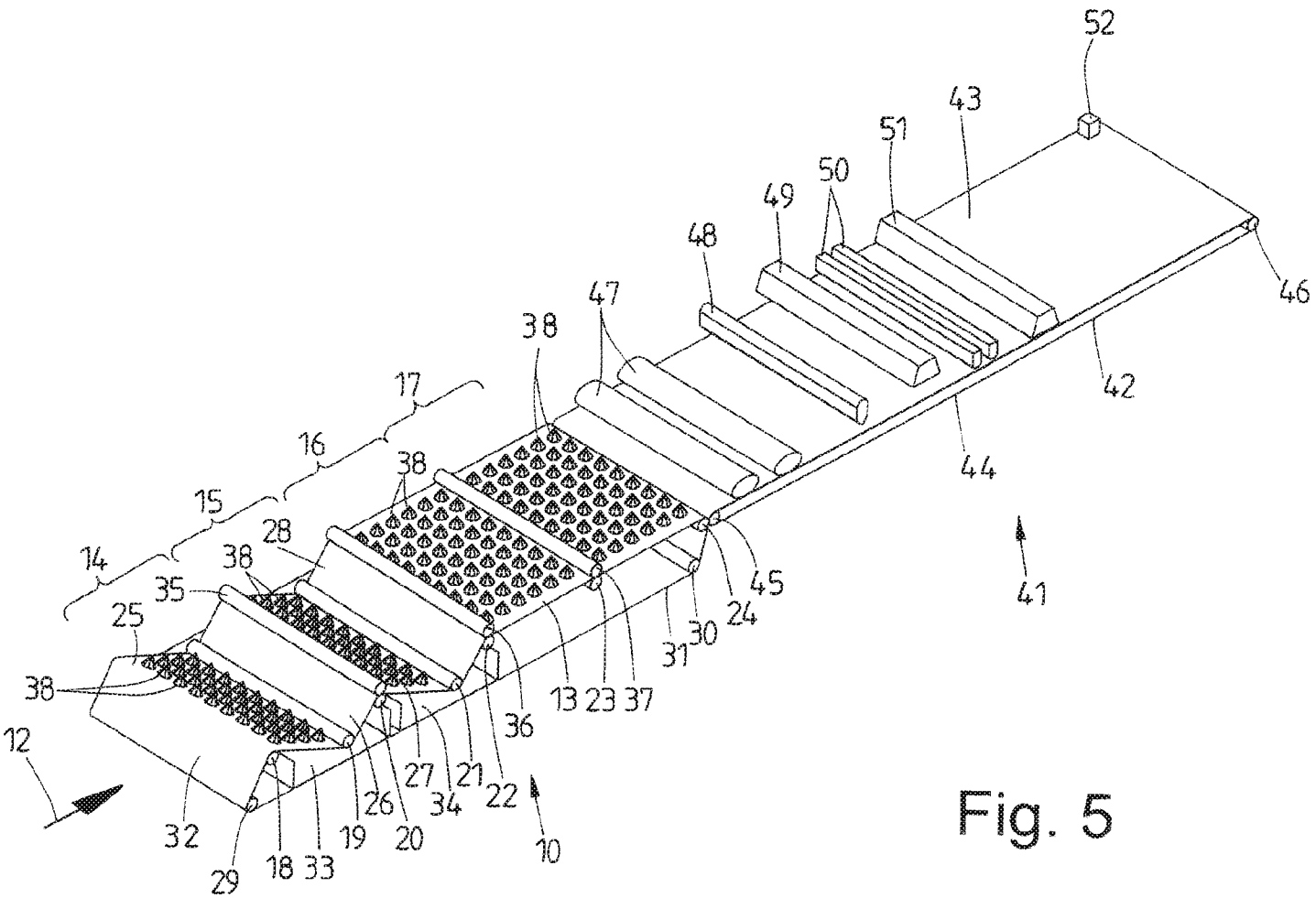
FIG. 5 shows a schematic perspective view of a device for the combined wet treatment and drying of laundry.
Figure 6:
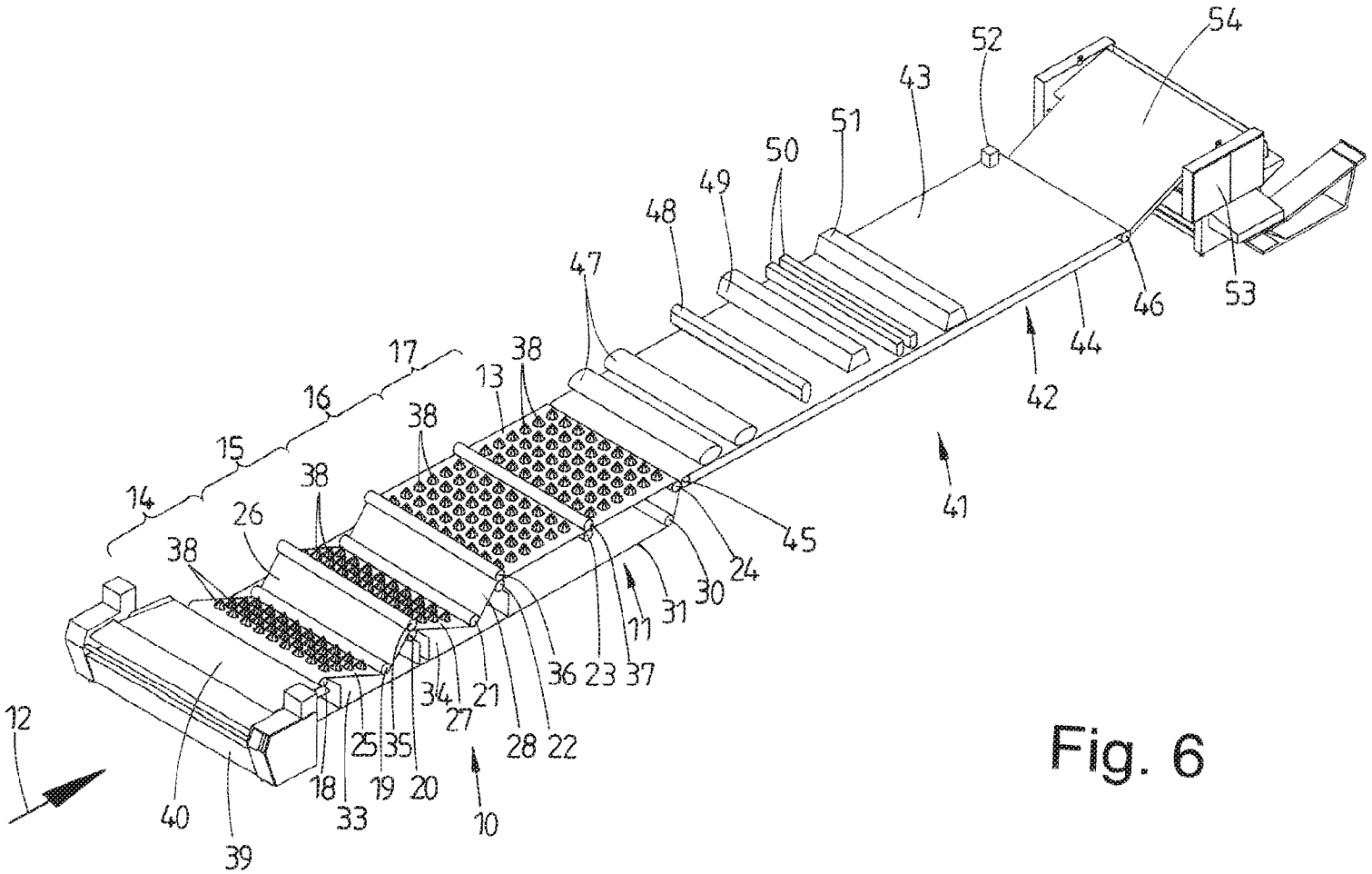
FIG. 6 shows the device of FIG. 5 with an upstream feeder station and a downstream folding machine.

FIGS. 5 and 6 show a device for the simultaneously combined wet treatment, in other words, the washing, rinsing and drying, of laundry or laundry items. This may involve all types of laundry or laundry items, preferably however flatware.

By virtue of linking a washing device and a dryer, the device represents a combined washing and drying range which first washes and rinses the laundry items and then dries them. If necessary, a disinfection of the laundry items can be made during the course of wet treatment (washing or rinsing) and/or in the course of drying.

For realizing the combined washing treatment and drying, the washing and rinsing device 10 as well as the dryer 41 are linked to each other by conveyors, preferably belt conveyors, which immediately follow one another in a virtually gap-free manner. As an alternative, the entire treatment range for washing and drying as well as for the drying of the laundry items can have only a single continuous conveyor or more than two conveyors. During the treatment the laundry items lie on the conveyors or, if applicable, on the single conveyor in the spread-out state. As a result, the laundry items rest in a flat state on the at least one conveyor.

The washing device 10 of FIGS. 5 and 6 corresponds to the washing device 10 shown in FIGS. 1 and 2. Reference is made to the relevant description as already presented. In the FIGS. 5 and 6 the same reference numbers are used for the same elements. The dryer 41 of FIGS. 5 and 6 corresponds to that of FIGS. 3 and 4. Reference is also made to the accompanying description. Here, too, the same reference numbers are employed.

As seen in the treatment direction 12, the belt conveyor 11 of the washing device 10 is immediately followed by the belt conveyor 42 of the dryer 41. As a result, the laundry items are able to be conveyed by the belt conveyor 11 in their unaltered spread-out state directly from the washing device 10 to the belt conveyor 42 of the dryer 41. If necessary, at least one transition means an be provided between the belt conveyors 11 and 42 which serves to transfer the washed laundry items from the washing device 10 to the dryer 41 in their unaltered spread-out and flatly lying state.

The method according to the invention is carried out in the device shown in FIGS. 5 and 6 as follows:

The laundry items lying flat in a spread-out state on one or multiple tracks on the upper strand 13 of the belt conveyor 11 in the loading section 32 of the belt conveyor 11 of the washing device 10 are first sprayed or sprinkled with liquid in the prewash zone 14 and subsequently a portion, preferably a major portion, of the prewash liquid is separated from the laundry items at the deflection drum 19 and between the squeegee roller 35 and the deflection drum 20 situated opposite thereto.

A regular washing of the laundry items is subsequently carried out in the main wash zone 15. In the process, the laundry items are first sprayed or sprinkled with clear wash liquid and subsequently a portion, in particular a major portion of the clear wash liquid bound in the laundry items is separated from them. This occurs at the deflection drum 21 and between the squeegee roller 36 and the deflection drum 22 associated with the latter. Afterwards, the washing process is finished.

The laundry items containing only a small portion of liquid from the washing process are then rinsed on the upper strand 13 of the belt conveyor 11. Rinsing is performed in succession, at first in the process water rinse zone 16 and then in the fresh water rinse zone 17. Thus, the laundry items are first sprayed or sprinkled with process water and then sprinkled, or alternatively, sprayed with fresh water. At the start, and if necessary also at the end, of the fresh water zone 17, a portion, preferably a major portion, of the rinse liquid bound the laundry items are separated from the latter, specifically process water at first and then, if applicable, fresh water.

If required, the laundry items can be disinfected in the washing device. This is preferably performed between the main wash zone 15 and the process water rinse zone 16. A chemical disinfection is preferred. One or more disinfection procedures may be carried out here.

Following the washing and rinsing, as well as any disinfection, the laundry items are transferred in their unaltered spread-out state from the upper strand 13 of the belt conveyor 11 of the washing device 10 to the upper strand 43 of the belt conveyor 42 of the dryer 41 and transported by the belt conveyor 42 through the dryer 41 in the treatment direction 12. The laundry items lying flat on the upper strand 43 are transported by the belt conveyor 42 along the successive drying units and, if applicable, the disinfection device in the treatment direction 12.

At least at the end of the dryer 41 the degree of dryness or the residual moisture of the laundry items is determined by at least one sensor in contactless manner. In case of any deviation from the desired degree of dryness or the desired residual moisture, a control or regulation of in particular the drying units of the dryer 41 is carried out. This can be done by changing the drying intensity at all or individually selected drying units, or as an alternative or in addition, also by turning a drying unit, or if applicable a plurality of drying units, on or off. The latter can also be carried out depending on the type of laundry items to be dried.

The device shown in FIGS. 5 and 6 serves for the uninterrupted and successively continuous washing, rinsing and drying, as well as any disinfection, of the laundry items transported through the washing device 10 and the dryer 41 on a single or double track by the belt conveyors 11 and 42 in the treatment direction 12. The device thus washes, rinses and dries the laundry items simultaneous in the run-through process. The laundry items always remain lying on the belt conveyors 11 and 42 in the spread-out and flat state. The laundry items are therefore washed, rinsed and dried in a resting state. If necessary, a disinfection of the laundry items is also carried out.

By linking the washing device 10 with the dryer 41 as a result of the belt conveyors 11 and 42 directly succeeding one another, a simultaneous, continuous wet treatment and drying procedure, as well as any necessary disinfection, is performed on the laundry items as they lie in a flat state on the upper strand 13 and 43 of the belt conveyors 11 and 42. In order to ensure the continuity of the wet treatment and drying process using the device of FIGS. 5 and 6, the belt conveyors 11 and 42 are preferably driven at the same speed. If it is determined that the desired degree of dryness or the desired residual moisture of the laundry items cannot be achieved at the end of the dryer, the speeds of the belt conveyors 11 and 42 of the washing device 10 and of the dryer 41 can be altered or adapted accordingly, preferably at the same time and/or similarly in conjunction with each other. The same applies in the case of treating, in particularly washing, heavily soiled laundry items.

FIG. 6 shows a device which corresponds to that of FIG. 5, but which however has a feeding machine 39 with a feed conveyor 40 upstream of the washing device 10 and with a folding machine 53, having a intake conveyor 54, being provided downstream of the dryer 41.

The laundry items to be treated can be automatically spread out by the feeding machine 39 and placed lying in a spread-out flat state on the upper strand 13 of the belt conveyor 11 of the washing device 10 along a single or double track.

The folding machine 53 arranged downstream of the dryer 41 as seen in the treatment direction 12 is employed for the automatic folding of the washed and dried, and if necessary disinfected, laundry items. This can be executed one or more times. The washed and dried laundry items are transferred along one or more tracks by the upper strand 43 of the belt conveyor 42 of the dryer 41 to the folding machine while maintaining their flat, spread-out state by being placed on the intake conveyor 54, namely an upper strand of the latter.

The device of FIG. 6 represents a treatment range for the continuous and successive automatic feeding of spread-out laundry items to the washing device 10 and for the automatic placement of the laundry items, which have been dried after their wet treatment, from the dryer 41 onto the intake conveyor 54 of the folding machine 53.

In place of the folding machine, a mangle can also be arranged downstream of the dryer 41. The dried laundry items (from the end of the belt conveyor 42 of the dryer 41) are transported in their spread-out state along one or more tracks to a loading conveyor of the mangle or directly to the inlet side of a trough-style mangle or another sort of mangle.

LIST OF REFERENCE NUMBERS

10 washing device
11 belt conveyor

12 treatment direction
13 upper strand
14 prewash zone
15 main wash zone
16 process water rinse zone
17 fresh water rinse zone
18 deflection drum
19 deflection drum
20 deflection drum
21 deflection drum
22 deflection drum
23 deflection drum
24 deflection drum
25 section
26 section
27 section
28 section
29 deflection drum
30 deflection drum
31 lower strand
32 loading section
33 collecting trough
34 collecting trough
35 squeegee roller
36 squeegee roller
37 squeegee roller
38 liquid cone
39 feeding machine
40 feed conveyor
41 dryer
42 belt conveyor
43 upper strand
44 lower strand
45 deflection drum
46 deflection drum
47 shock wave applicator
48 row of air nozzles
49 hot air beam
50 disinfection beam
51 infrared radiator
52 infrared sensor
53 folding machine
54 intake conveyor

What is claimed is:

1. A method for a wet treatment and drying of laundry which is washed and rinsed in the wet treatment and that during a drying phase of the drying a bound liquid from the wet treatment is extracted to at least a large extent, comprising: placing the laundry in a spread-out state on a start of a conveyor in a region of the wet treatment, the conveyor comprising at least one belt conveyor (11, 42);

conducting the wet treatment and the drying on laundry that is lying on the conveyor in a spread-out state and along a continuous treatment path;

drying the laundry immediately following the wet treatment along the continuous treatment path; and then transferring the dried laundry in its spread-out state by the conveyor in a drying region directly to an intake conveyor of a downstream laundry treatment device.

2. The method as claimed in claim 1, wherein the wet treatment is conducted on a first of the at least one belt conveyor (11) and the drying is conducted on a second of the at least one belt conveyor (42) along the continuous treatment path and/or a transport speed of the conveyors first belt conveyor (11) and the second belt conveyor (42) are coordinated with each other in the region of the wet treatment and the drying.

3. The method as claimed in claim 1, wherein the laundry is transported in a spread-out state on the conveyor through at least one drying section, wherein the laundry is dried successively with a plurality of consecutive drying units.

4. The method as claimed in claim 1, wherein the laundry is washed in at least one liquid and subsequently rinsed, and the laundry is sprayed and/or sprinkled in the spread-out state with at least one liquid.

5. The method as claimed in claim 4, wherein the laundry is sprayed and/or sprinkled with pressurized liquid and/or liquid jets at a high velocity.

6. The method as claimed in claim 4, wherein the laundry is sprayed and/or sprinkled in a lying and/or resting state with at least one liquid, wherein the laundry is sprayed and/or sprinkled with the at least one liquid in a state of lying on a conveyor and/or of resting on the conveyor.

7. The method as claimed in claim 4, wherein at least one liquid is sprayed and/or sprinkled on a free side of the laundry and that at least part of this liquid is drained off from an opposite side of the laundry.

8. The method as claimed in claim 4, wherein following or during the washing at least part of the at least one liquid bound in the laundry is removed from the laundry.

9. The method as claimed in claim 4, wherein the laundry is washed in a prewash zone and a main wash zone and is rinsed in at least one rinse zone.

10. The method as claimed in claim 4, wherein during the wet treatment the laundry is disinfected in an ultrasonic bath.

11. The method as claimed in claim 4, wherein the laundry is transported through all zones of the wet treatment in an uninterrupted manner.

12. The method as claimed in claim 1, wherein the laundry is dried successively with a plurality of consecutive drying units.

13. The method as claimed in claim 12, wherein at least some of the drying units are arranged transverse to a treatment direction above the conveyor carrying the laundry and/or at least one drying unit forms a drying strip arranged above the conveyor and running transversely to the treatment direction.

14. The method as claimed in claim 12, wherein the drying units are selected from the group consisting of hot air generators, infrared radiators, at least one row of air nozzles, and at least one shock wave applicator.

15. The method as claimed in claim 12, wherein at least one row of air nozzles, fed with ambient air and/or waste heat, are employed as a drying unit.

16. The method as claimed in claim 12, further comprising performing a dry disinfection of the laundry.

17. The method as claimed in claim 12, wherein at least one sensor directed at the laundry to be dried determines a residual moisture, a degree of dryness and/or a temperature of the laundry and on the basis of measured values the drying is controlled by controlling the drying units employed for drying.

18. A method for a wet treatment and drying of laundry which is washed and rinsed in the wet treatment and that during a drying phase of the drying a bound liquid from the wet treatment is extracted to at least a large extent, comprising:

transferring the laundry in a spread-out state by a feeding machine to a start of a conveyor in a region of the wet treatment, the conveyor comprising at least one belt conveyor (11, 42):

conducting the wet treatment and the drying on laundry that is lying on the conveyor in a spread-out state and along a continuous treatment path;

drying the laundry immediately following the wet treatment along the continuous treatment path; and then transferring the dried laundry in its spread-out state by the conveyor in a drying region directly to a folding machine or a mangle.

19. The method as claimed in claim 18, wherein the wet treatment is conducted on a first of the at least one belt conveyor (11) and the drying are_is conducted on separate conveyors a second of the at least one belt conveyor (42) along the continuous treatment path and/or the transport speed of the conveyors first belt conveyor (11) and the second belt conveyor (42) are coordinated with each other in the region of the wet treatment and the drying.

20. The method as claimed in claim 18, wherein the laundry is transported in a spread-out state on the conveyor through at least one drying section, wherein the laundry is dried successively with a plurality of consecutive drying units.

21. The method as claimed in claim 18, wherein the laundry is washed in at least one liquid and subsequently rinsed, and the laundry is sprayed and/or sprinkled in the spread-out state with at least one liquid.

22. The method as claimed in claim 21, wherein the laundry is sprayed and/or sprinkled with pressurized liquid and/or liquid jets at a high velocity.

23. The method as claimed in claim 21, wherein the laundry is sprayed and/or sprinkled in a lying and/or resting state with at least one liquid, wherein the laundry is sprayed and/or sprinkled with the at least one liquid in a state of lying on a conveyor and/or of resting on the conveyor.

24. The method as claimed in claim 21, wherein at least one liquid is sprayed and/or sprinkled on a free side of the laundry and that at least part of this liquid is drained off from an opposite side of the laundry items.

25. The method as claimed in claim 21, wherein following or during the washing at least part of the liquid bound in the laundry is removed from the laundry.

26. The method as claimed in claim 21, wherein the laundry is washed in a prewash zone and a main wash zone and is rinsed in at least one rinse zone.

27. The method as claimed in claim 21, wherein during the wet treatment the laundry is disinfected in an ultrasonic bath.

28. The method as claimed in claim 21, wherein the laundry is transported through all zones of the wet treatment in an uninterrupted manner.

29. The method as claimed in claim 18, wherein the laundry is dried successively with a plurality of consecutive drying units.

30. The method as claimed in claim 29, wherein at least some of the drying units are arranged transverse to a treatment direction above the conveyor carrying the laundry and/or at least one drying unit forms a drying strip arranged above the conveyor and running transversely to the treatment direction.

31. The method as claimed in claim 29, wherein the drying units are selected from the group consisting of hot air generators, infrared radiators, at least one row of air nozzles, and at least one shock wave applicator.

32. The method as claimed in claim 29, wherein at least one row of air nozzles, fed with ambient air and/or waste heat, are employed as a drying unit.

33. The method as claimed in claim 29, further comprising performing a dry disinfection of the laundry.

34. The method as claimed in claim 29, wherein at least one sensor directed at the laundry to be dried determines a residual moisture, a degree of dryness and/or a temperature of the laundry and on the basis of measured values the drying is controlled by controlling the drying units employed for drying.

* * * * *